US005816439A

United States Patent [19]

Lovell et al.

[11] Patent Number: 5,816,439

[45] Date of Patent: Oct. 6, 1998

[54] CONTAINER WITH HANDLE

[75] Inventors: Peter Lovell, Oakville; Ronald J. Sturk, Brampton, both of Canada

[73] Assignee: Industrial Containers Ltd., Canada

[21] Appl. No.: 727,611

[22] PCT Filed: Feb. 16, 1996

[86] PCT No.: PCT/CA96/00098

§ 371 Date: May 16, 1997

§ 102(e) Date: May 16, 1997

[87] PCT Pub. No.: WO96/25338

PCT Pub. Date: Aug. 22, 1996

[30] Foreign Application Priority Data

Feb. 17, 1995 [GB] United Kingdom ..... 9503145

[51] Int. Cl.[6] ..... B65D 25/32

[52] U.S. Cl. ..... 220/760; 220/761; 220/770; 220/776

[58] Field of Search ..... 220/760, 770, 220/761, 776, 759

[56] References Cited

U.S. PATENT DOCUMENTS

| | | | |
|---|---|---|---|
| 3,451,590 | 6/1969 | Johnson et al. | 220/761 |
| 4,476,083 | 10/1984 | Von Holdt . | |
| 4,673,625 | 6/1987 | McCartney et al. | 220/760 |
| 5,287,990 | 2/1994 | Knox . | |
| 5,344,041 | 9/1994 | Luburic et al. . | |
| 5,526,956 | 6/1996 | Georgiadis | 220/760 |

FOREIGN PATENT DOCUMENTS

| | | |
|---|---|---|
| 722573 | 1/1955 | United Kingdom . |
| 2051726 | 1/1981 | United Kingdom . |
| 9625338 | 8/1996 | WIPO . |

*Primary Examiner*—Joseph M. Moy
*Attorney, Agent, or Firm*—Fredrikson & Byron, PA

[57] ABSTRACT

A container having walls and a handle attached to the exterior of the container is disclosed. The container has handle receiving means in the form of a keyhole-shaped slot spaced apart from the wall of the container by a distance sufficient to accommodate a flange on the end of the handle. The keyhole-shaped slot has an orifice connected to a tapered slot which is open at the end opposed to the orifice. A shaft located at the end of the handle at each of its opposed ends has two spaced-apart flanges thereon. The shaft and the keyhole cooperatively act for insertion of the shaft into the orifice of the keyhole. At least one of the flanges attached to the handle is sectioned to form an edge in the shape of a hook. During insertion of the handle onto the container, the hook contacts a fulcrum located juxtaposed to the tapered slot of the keyhole which acts as a lever to snap the handle onto the container.

28 Claims, 6 Drawing Sheets

CONTAINER WITH HANDLE

The present invention relates to a container with a handle, and especially to a container with a handle attached to opposite sides of the exterior of the container. In embodiments, the container is a pail.

Many containers are difficult to move or carry and for this reason it is common practice to provide a handle on the container. Such handles may come in a wide variety of forms, including separate handles on opposite sides of the container e.g. particularly when the container is in the form of a box, or a handle that extends from one side to the other side of the container e.g. when the container is in the form of a pail or similar construction.

For containers made from wood, metal, cardboard or the like, the handle may be attached to the container by suitable welding, adhesive or gluing methods. Alternatively in some constructions and with some materials, it is possible to integrally form the handle on the container during manufacture of the container e.g. in a moulding process.

With containers made with some materials e.g. plastics and especially polyolefins, it is more difficult to attach the handle using adhesive or melt bonding technology. Other methods tend to be used to attach the handles, for instance suitable slots may be provided on the exterior of the container such that the handle may be inserted into the slots to attach the handle to the container.

A variety of shapes of slots have been provided on containers, with the dual purpose of facilitating assembly of the container as well as providing a container with a handle that is not readily detachable from the container during use. Such slots have included slots in the shape of a keyhole or other similar shapes, with the handle being snap-fitted onto the container using the slot.

The constricted portion of key-hole shaped slots has to be designed such that it is possible to snap fit the handle through the constricted part but retain the handle on the container during normal use and especially when the container is not being moved e.g. when the handle falls downwardly over the side of the container. Such assembly of handles on containers using snap fitting techniques can be done using machines, but it is frequently carried out in a manual operation. Manual operation requires significant strength and effort by the person who is attaching the handles to the containers, and may over a period of time result in strains to joints of the operator e.g. to wrist and elbow joints and consequent occupational health problems.

A container having its handle attached by snap-fitting in an alternative manner has now been found.

Accordingly the present invention provides a container having walls and a handle attached to the exterior of the container;

said handle having two opposed ends, each of which is attached to the container, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

said shaft and said keyhole cooperatively being of diameters such that the shaft may be slid along the tapered slot and forcibly inserted into the orifice, at least one flange being sectioned to form an edge on said flange that passes from the perimeter of the flange to the shaft and thereafter curves back towards the perimeter on the opposed side of the shaft, forming a hook shape;

a fulcrum located juxtaposed to the tapered slot of the keyhole at a distance from the orifice such that the fulcrum is spaced apart from the flange when the shaft is located in the orifice but at a distance from the longitudinal axis of the keyhole that is less than the radius of the sectioned flange;

said fulcrum being located such that contact is made with the sectioned flange during installation of the handle on the container.

The present invention further provides a container having walls and a handle attached to the exterior of the container;

said handle having two opposed ends, each of which is attached to the container, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

said shaft and said keyhole cooperatively being of diameters such that the shaft may be slid along the tapered slot and forcibly inserted into the orifice, at least one flange being sectioned to form an edge on said flange that passes from the perimeter of the flange to the shaft and thereafter curves back towards the perimeter on the opposed side of the shaft, forming a hook shape;

a pin located juxtaposed to the tapered slot of the keyhole at a distance from the orifice such that the pin is spaced apart from the flange when the shaft is located in the orifice but at a distance from the longitudinal axis of the keyhole that is less than the radius of the sectioned flange;

said pin being located such that contact is made with the sectioned flange during installation of the handle on the container.

In a preferred embodiment of the container of the present invention, a ridge is located near the pin, said ridge having a side parallel to the longitudinal axis of the keyhole and spaced apart therefrom by a distance equal to the radius of the flange, said pin and ridge being located such that contact is made with the sectioned flange during installation of the handle on the container.

The present invention also provides a container having walls and a handle attached to the exterior of the container;

said handle having two opposed ends, each of which is attached to the container, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

said shaft and said keyhole cooperatively being of diameters such that the shaft may be slid along the tapered slot and forcibly inserted into the orifice, at least one flange being sectioned to form an edge on said flange that passes from the perimeter of the flange to the shaft and thereafter curves back towards the perimeter on the opposed side of the shaft, forming a hook shape;

a ridge extending along one edge of the keyhole slot and around a major section of said keyhole orifice, said ridge increasing in height between said open end of the tapered slot and said orifice, said ridge cooperatively contacting said sectioned flange for insertion of handle through said keyhole slot and into said orifice.

In embodiments of the invention, the flanges on the shaft are spaced apart, with one flange attached to said handle.

In other embodiments, the flanges on the shaft are spaced apart, and separated from said handle.

In further embodiments, one or both flanges is sectioned, and if only one flange is sectioned it may be either the flange proximal to the handle or the flange distal to the handle.

In another embodiment, the container is a pail.

The invention further provides a method of attaching a handle to the exterior of a container, said handle having two opposed ends, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

at least one flange being sectioned to form an edge on said flange that passes from the perimeter of the flange to the shaft and thereafter curves back towards the perimeter on the opposed side of the shaft, forming a hook shape;

said process comprising inserting said shaft into said tapered slot and urging towards said orifice;

rotating said handle such that said sectioned flange contacts a fulcrum and rotates to urge said shaft of the handle into the orifice.

In a preferred embodiment of the method of the invention, a pin is located juxtaposed to said tapered slot, said pin being located such that contact is made with the sectioned flange during attachment of the handle to the container, said pin being a fulcrum about which said flange is rotated.

In another preferred embodiment of the method of the invention, said tapered slot has a ridge extending along the edge thereof such that contact is made with the sectioned flange during attachment of the handle to the container, said ridge being a fulcrum about which said flange is rotated.

In a further embodiment, the handle receiving means has both said pin and said ridge.

In further embodiments, one or both flanges is sectioned, and if only one flange is sectioned it may be either the flange proximal to the handle or the flange distal to the handle.

In another embodiment, the container is a pail.

The present invention is illustrated by the embodiments shown in the drawings, in which.

Figure 1:
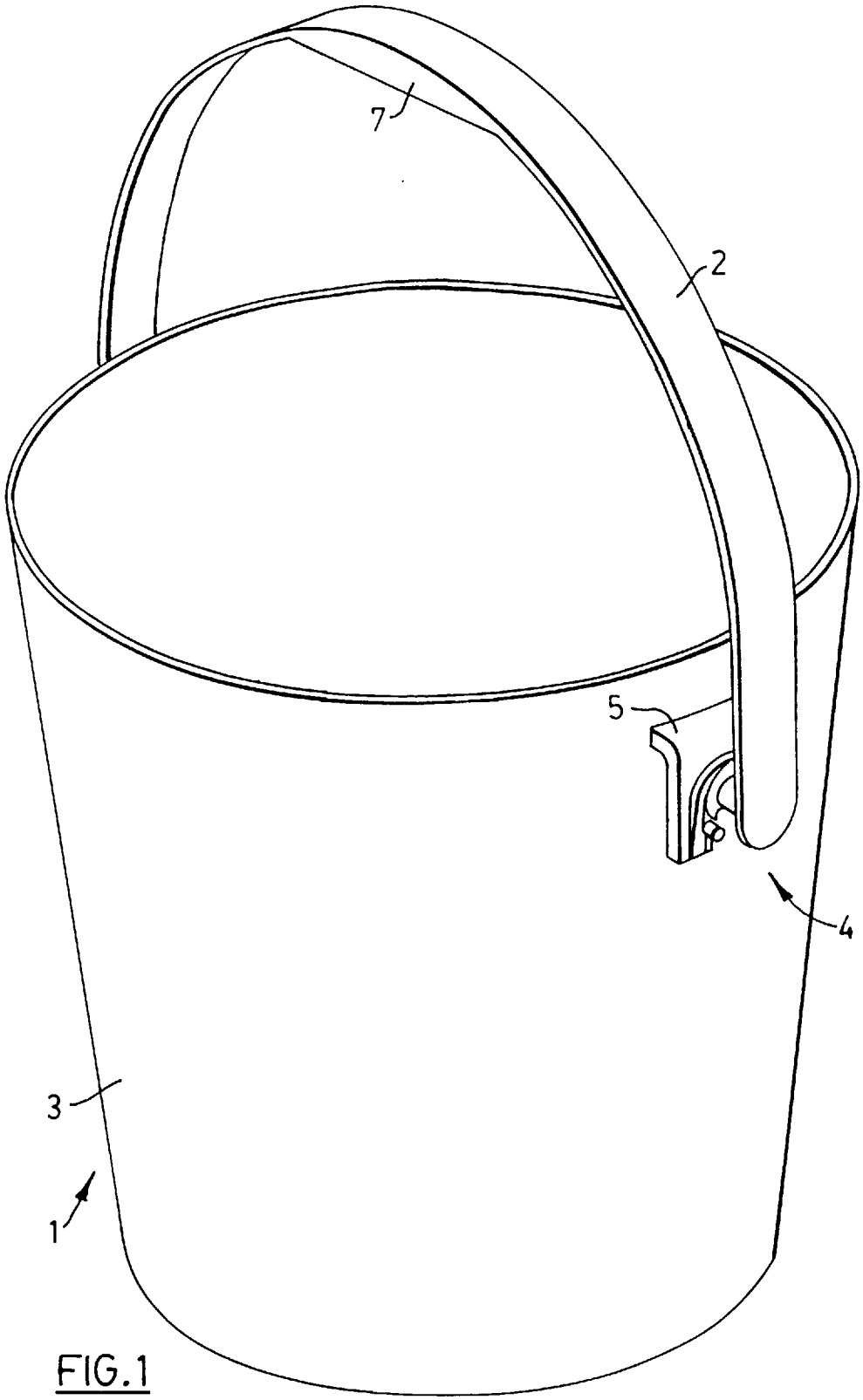
FIG. 1 is a schematic representation of a pail with a handle attached.

Referring to FIG. 1, a container, generally shown by 1, is shown as having a handle 2 and a pail 3. Handle 2 is attached to pail 3 by means of handle attachment 4 and pail attachment 5, shown in more detail in the other drawings. Handle 2 is shown as having a grip 7, which is for the convenience of the users of the container.

Figure 2:
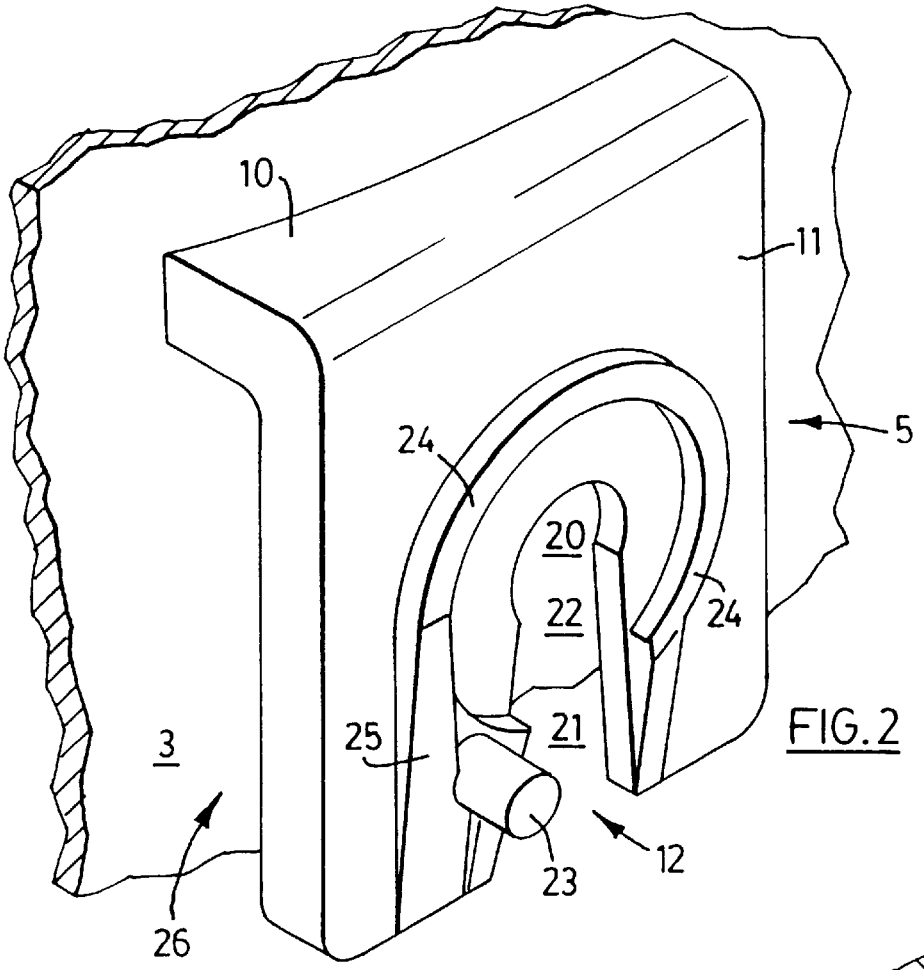
FIG. 2 is a schematic representation of a side elevational view of the attachment on the pail.

FIG. 2 shows pail 3 with pail attachment 5. Pail attachment 5 has a pail section 10 that is attached to the pail, and a keyhole section 11 that is shown as extending downwardly with regard to pail section 10 and substantially parallel to the side of pail 3. Keyhole section 11 has keyhole 12. Keyhole 12 has orifice 20 and tapered slot 21 which meet at keyhole slot 22. Keyhole slot 22 is of a width such that shaft 15, discussed below with reference to FIG. 3, of handle attachment 4 may be forcibly passed through keyhole slot 22 into orifice 20, and normally retained therein. Tapered slot 21 functions primarily as a guide for bringing shaft 15 into orifice 20, as discussed below. Pin 23 is located juxtaposed to tapered slot 21 of keyhole 12. A guide 24 extends around orifice 20, spaced away from orifice 20 at a distance to accommodate flanges 13 and 14 on handle attachment 4. This permits movement of handle 2 while attached to container 1, with guide 24 acting to retain the flanges and provide stability to the handle attachment. Ridge 25 extends away from pin 23 tapering down onto guide 24. It is preferred that ridge 25 have its edge parallel to the longitudinal axis of keyhole 12 and be spaced apart therefrom by a distance equal to the radius of the flange. Opening 26 is of the size to accommodate distal flange 14, between keyhole section 11 and pail 3.

Figure 3:
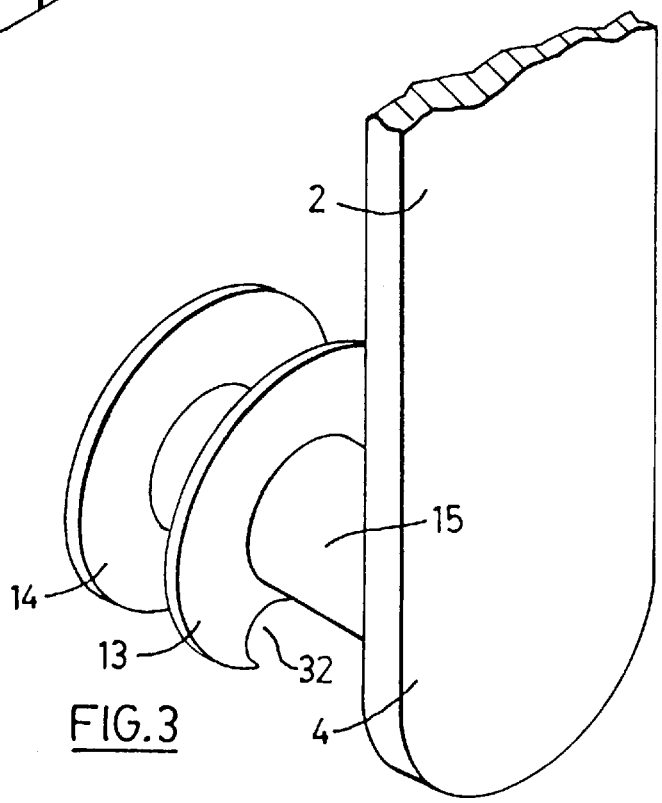
FIGS. 3 and 3A are a schematic representations of embodiments of a side elevational view of the attachment on the handle.

FIG. 3 shows handle attachment 4 of handle 2 as having proximal flange 13 and distal flange 14 attached to shaft 15. Proximal flange 13 is shown as being spaced apart from handle 2. Proximal flange 13 is a sectioned flange, more clearly shown as sectioned flange 30 in FIG. 5. Proximal flange 13 is shown as having hook 32, also more clearly seen in FIG. 5. In the embodiment shown, hook 32 is generally C-shaped.

In the embodiment shown in FIG. 3, the sectioned flange is shown as being part of proximal flange 13. It is to be understood, however, that the sectioned flange could be located on distal flange 14 or on both of proximal flange 13 and distal flange 14.

Figure 3A:
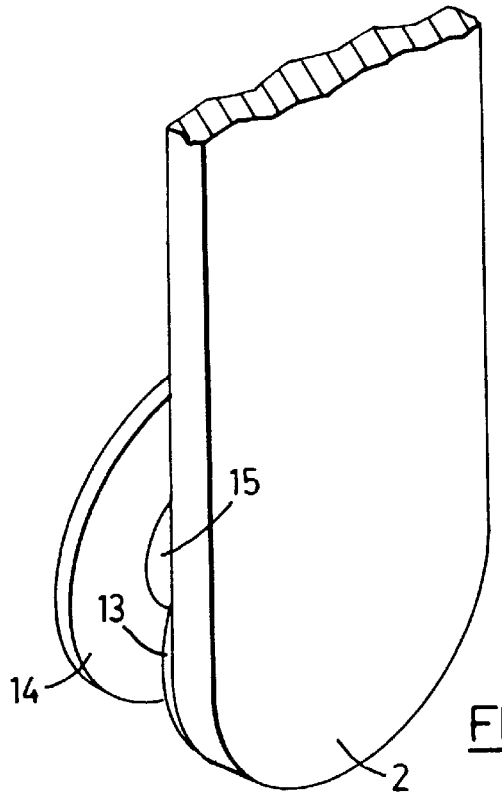

FIG. 3A shows a preferred embodiment in which proximal flange 13 is attached to handle 2. Proximal flange 13 may be a sectioned flange, as described herein, and in preferred embodiments it is a sectioned flange.

Figure 4:
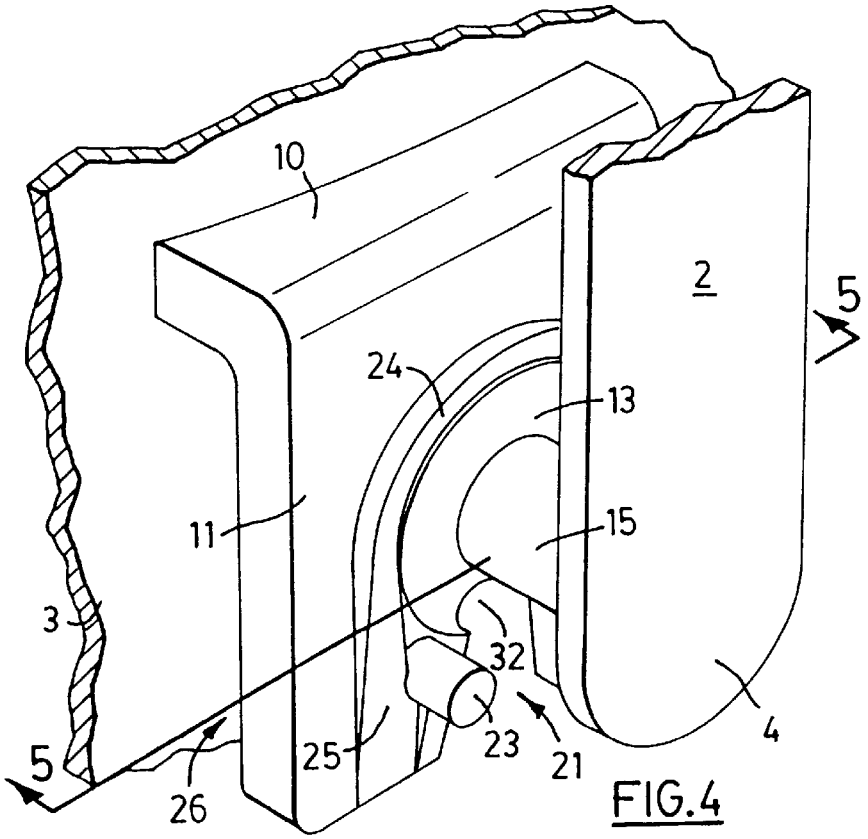
FIG. 4 is a schematic representation of a side elevational view of the handle attachment located in the pail attachment.

FIG. 4 shows the handle attached to the container i.e. handle attachment 4 is located in pail attachment 5. Proximal flange 13 is shown located within guide 24 such that the perimeter of proximal flange 13 is located within guide 24, and juxtaposed thereto. Proximal flange 13 is free to rotate within guide 24, both during installation of handle attachment 4 into pail attachment 5, and during subsequent use of the container. Other details shown in FIG. 4 have been described previously.

With reference to FIG. 5, sectioned flange 30 is a section removed from proximal flange 13, beginning at flange perimeter 31 and proceeding tangentially, in the embodiment shown, passed shaft 15 and then curving through hook 32 back to perimeter 31. The straight portion of sectioned flange 30 is shown as being on the opposed side of shaft 15 from that of hook 32. In the embodiment shown, hook 32 is generally C-shaped.

FIG. 5 shows assembly of handle 2 onto pail 3, or more particularly handle 2 into keyhole section 11 of pail attachment 5. In order to assemble handle 2 into keyhole section 11, shaft 15 of handle attachment 2 is moved into keyhole slot 12. Shaft 15 is of a size that will fit into tapered slot 21 of keyhole section 11 and pass through keyhole slot 22 into orifice 20. Keyhole slot 22 is of a size that shaft 15 may be snap fitted therethrough into orifice 20 but retain shaft 15 within orifice 20 during normal use of the container. Shaft 15 is moved into tapered slot 21 such that distal flange 14 is located on one side of keyhole section 11, fitting into opening 26, and proximal flange 13 is located on the other side of keyhole section 11. In the embodiment shown in FIG. 5, pin 23 is located adjacent to proximal flange 13, and proximal flange 13 has sectioned flange 30.

Figure 5A:
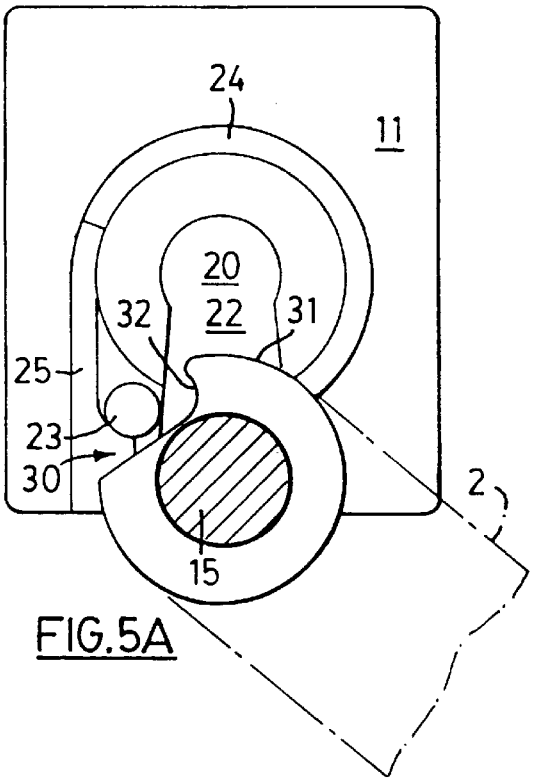
FIGS. 5A–5D is a schematic representation of steps in the attachment of handle to the pail.
Figure 5B:
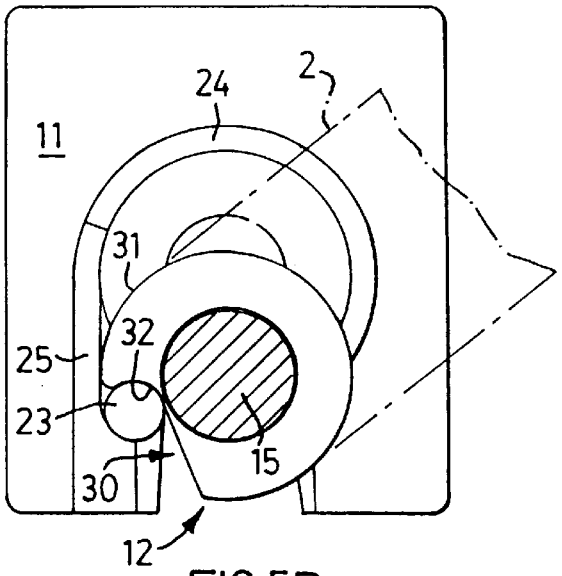
Figure 5C:
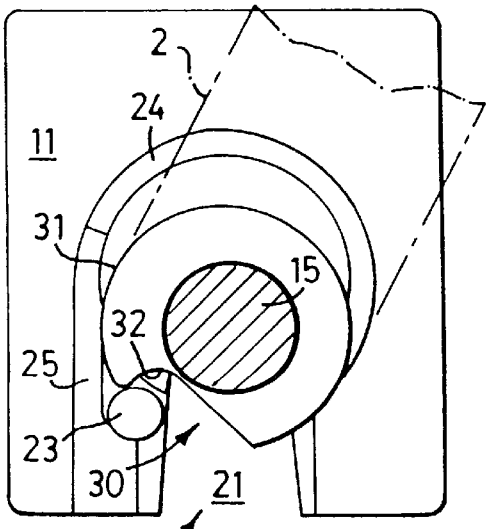
Figure 5D:
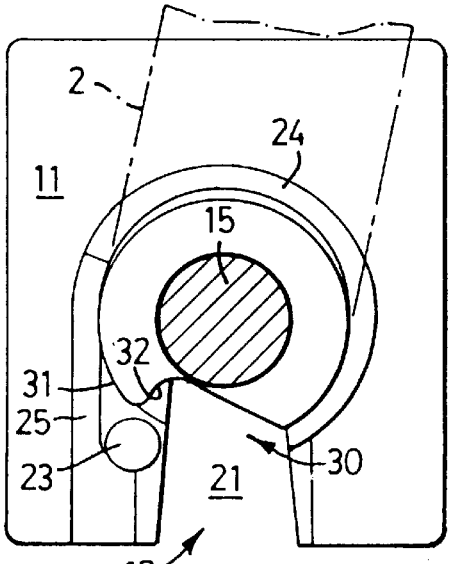

As shaft 15 is inserted into tapered slot 21, as shown in FIG. 5A, hook 32 of sectioned flange 30 is located so that it may be rotated to curl around pin 23, as shown in FIG. 5B. Perimeter 31 of proximal flange 13 is moved into contact with ridge 25 that extends away from pin 23 and tapers down onto guide 24, again as shown in FIG. 5B. Handle 2 is then rotated further such that perimeter 31 continues to move along and in contact with ridge 25, as shown in FIG. 5C. Pin 23 acts as a fulcrum for sectioned flange 20. Shaft 15 is snapped through keyhole slot 22, using a lever motion about pin 23 as fulcrum, such that shaft 15 becomes located within orifice 20, as shown in FIG. 5D.

Pin 23, ridge 25 and guide 24 are all of dimensions and located such that, in cooperation with hook 32 and perimeter 31, pin 23 may act as a lever with respect to hook 32 and ridge 25 may act further as a lever with respect to perimeter 31, to facilitate insertion, by a snapping motion, of shaft 15 through keyhole slot 22 into orifice 20.

As discussed above, sectioned flange 30 may be located on proximal flange 13, or on distal flange 14, or on both proximal flange 13 and distal flange 14. Pin 23 would need to be suitably and cooperatively located on one or both sides of keyhole section 11 in order that it may act as a lever, using hook 32, for the insertion of shaft 15 into orifice 20.

Tapered slot 21 is shown as having straight sides, but it may have other shapes. Tapered slot 21 is intended to act as a guide for insertion of shaft 15 into orifice 20.

Hook 32 is preferably shaped so that during assembly of the handle onto the container, the centre of shaft 15 is directed towards and through the centre of keyhole slot 22. This will facilitate easy assembly.

In preferred embodiments, shaft 15 is preferably perpendicular or substantially perpendicular to handle 2.

Figure 6:
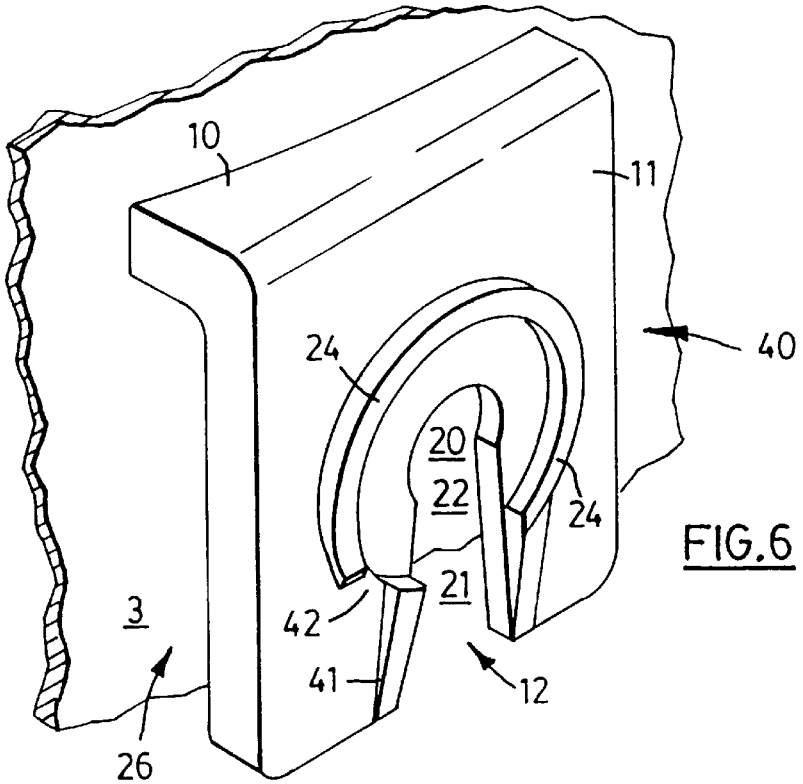
FIG. 6 is a schematic representation of a side elevational view of an alternate embodiment of the attachment on the pail.

FIG. 6 shows an alternate embodiment, showing pail 3 with pail attachment 40. Pail attachment 40 has pail section 10 that is attached to the pail, and keyhole section 11 that is shown as extending downwardly with regard to pail section 10 and substantially parallel to the side of pail 3. Keyhole section 11 has keyhole 12. Keyhole 12 has orifice 20 and tapered slot 21 which meet at keyhole slot 22. Keyhole slot 22 is of a width such that shafts 15 of handle attachment 4, discussed herein, may be forcibly passed through keyhole slot 22 into orifice 20, and normally retained therein. Tapered slot 21 functions primarily as a guide for bringing shaft 15 into orifice 20, as discussed herein.

The embodiment of FIG. 6 differs from that of FIG. 2 primarily in that pin 23 of FIG. 2 is absent in FIG. 6. Guide 24 extends around orifice 20, spaced away from orifice 20 at a distance to accommodate flanges 13 and 14 on handle attachment 4, as described above. Guide 24, in the embodiment of FIG. 6, extends around orifice 20, terminating prior to tapered slot 21, thereby provided gap 42 between guide 24 and tapered ridge 41. Tapered ridge 41 extends therefrom down the edge of tapered slot 21 of keyhole 12 for the full length of keyhole 12, decreasing in height as it does so.

Figure 7:
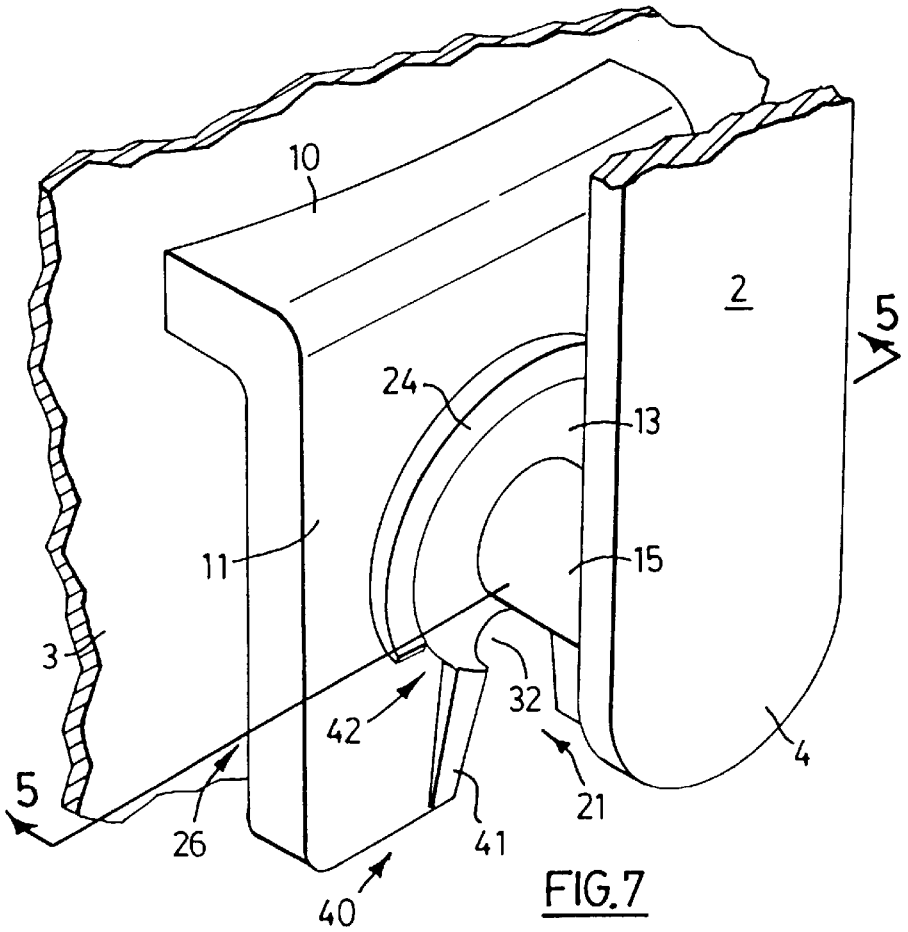
FIG. 7 is a schematic representation of a side elevational view of an alternate embodiment of the handle attachment located in the pail attachment.
Figure 8A:
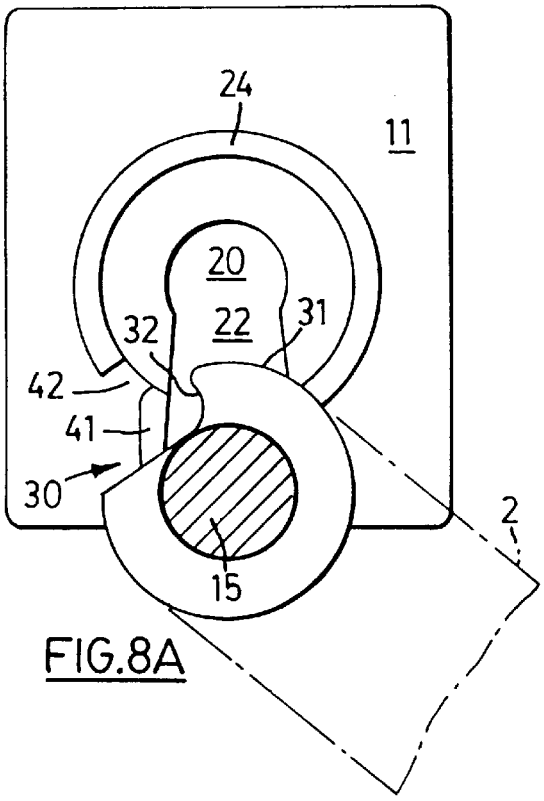
FIGS. 8A–8D is a schematic representation of steps in the attachment of the alternate embodiment of the handle to the pail.
Figure 8B:
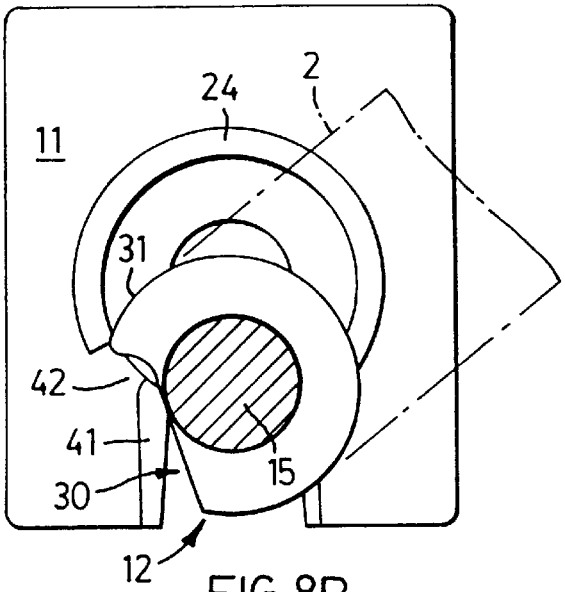
Figure 8C:
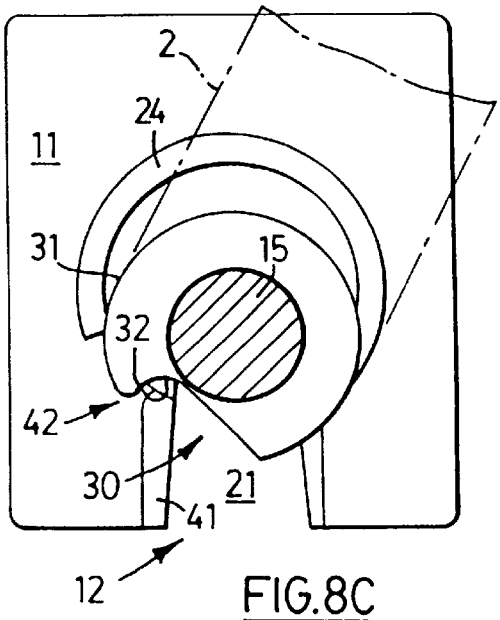
Figure 8D:
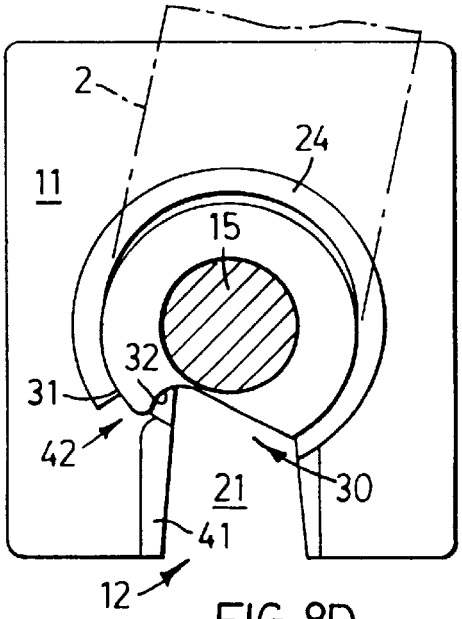

FIG. 7 shows the handle attached to the container i.e. the handle attachment 4 is located in pail attachment 40. Details of FIG. 7 have been described elsewhere, especially with respect to FIG. 4, except that FIG. 7 is directed to the embodiment using pail attachment 40 and tapered ridge 41.

FIG. 8 shows assembly of handle 2 into pail 3, using the alternate embodiment of the invention. The procedure used is the same as that used and described with respect to FIG. 5, with guide 24 and ridge 41, and gap 42 therebetween acting as the fulcrum. In preferred embodiments of the invention, the pail attachment is in the form of pail attachment 40 shown in FIGS. 6–8. In addition in the preferred embodiment, the proximal flange 13 may be, and is preferably, attached to handle 2, as shown and discussed with respect to FIG. 3A.

The handle attachment described herein may be used on a variety of containers. In particular, it may be used on open-mouthed containers, especially pails. It is preferred that the handle be flexible, to a small extent, for ease of assembly.

Use of the sectioned flange in combination with the pin, or preferably in combination with the ridge, facilitates insertion of the handle attachment into the pail attachment, thereby attaching the handle to the pail and forming a container with a handle. Such attachment of the handle to the pail may be accomplished with less effort using the attachment means as described herein in comparison with similar attachment means not having the pin and/or ridge as described herein.

Attachment of a handle onto a pail as described herein may be accomplished with relatively little effort. In particular, the handle attachment may be inserted into the pail attachment, by a twisting motion. With minimal effort, the handle will snap into the handle attachment. This is readily and routinely accomplished by a person, with comparative ease.

In both of the embodiments particularly described herein, the attachment of the handle attachment to the pail attachment is accomplished by a lever action, thereby requiring little effort in order to effect the attachment of the handle to the pail. Moreover the handle when attached to the pail is not readily removed therefrom, and in particular can be most difficult to remove even though it was attached in a very simple quick operation.

We claim:

1. A container having walls and a handle attached to the exterior of the container;

said handle having two opposed ends, each of which is attached to the container, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

said shaft and said keyhole cooperatively being of diameters such that the shaft may be slid along the tapered slot and forcibly inserted into the orifice, at least one flange being sectioned to form an edge on said flange that passes from the perimeter of the flange to the shaft and thereafter curves back towards the perimeter on the opposed side of the shaft, forming a hook shape;

a fulcrum located juxtaposed to the tapered slot of the keyhole at a distance from the orifice such that the pin is spaced apart from the flange when the shaft is located in the orifice but at a distance from the longitudinal axis of the keyhole that is less than the radius of the sectioned flange;

said fulcrum being located such that contact is made with the sectioned flange during attachment of the handle on the container.

2. The container of claim 1 in which the fulcrum is a pin.

3. The container of claim 2 in which a ridge is located near the pin, said ridge having a side parallel to the longitudinal axis of the keyhole and spaced apart therefrom by a distance equal to the radius of the flange, said pin and ridge being located such that contact is made with the sectioned flange during installation of the handle on the container.

4. The container of claim 1 in which the fulcrum is a ridge, said ridge extending along one edge of the keyhole slot and around a major section of said keyhole orifice, said ridge increasing in height between said open end of the tapered slot and said orifice, said ridge cooperatively contacting said sectioned flange for insertion of handle through said keyhole slot and into said orifice.

5. The container of claim 1 in which the flanges on the shaft are spaced apart, with one flange attached to said handle.

6. The container of claim 1 in which the flanges on the shaft are spaced apart, and separated from said handle.

7. The container of claim 1 in which one flange is sectioned.

8. The container of claim 1 in which the flange proximal to the handle is sectioned.

9. The container of claim 1 in which the flange distal to the handle is sectioned.

10. The container of claim 1 in which both flanges are sectioned.

11. The container of claim 1 in which the shaft is substantially perpendicular to the handle.

12. The container of claim 1 in which the edge of the sectioned flange is, in part, juxtaposed and tangential to the shaft.

13. The container of claim 1 in which the flange proximal to the handle is spaced apart therefrom.

14. The container of claim 1 in which the handle is flexible.

15. The container of claim 1 in which the container is an open-mouthed container.

16. The container of claim 15 in which the container is a pail.

17. A method of attaching a handle to the exterior of a container, said handle having two opposed ends, each of said ends having a shaft with two spaced-apart flanges thereon;

said container having handle receiving means in the form of a keyhole-shaped slot spaced apart from the wall of the container by a distance sufficient to accommodate the flange distal to the handle, said keyhole shaped slot having an orifice connected to a tapered slot, said tapered slot being open at the end opposed to the orifice;

at least one flange being sectioned to form an edge on said flange that passes from the perimeter of the flange to the shaft and thereafter curves back towards the perimeter on the opposed side of the shaft, forming a hook shape;

said process comprising inserting said shaft into said tapered slot and urging towards said orifice;

rotating said handle such that said sectioned flange contacts a fulcrum and rotates to urge said shaft of the handle into the orifice.

18. The method of claim 17 in which a pin is located juxtaposed to said tapered slot, said pin being located such that contact is made with the sectioned flange during attachment of the handle to the container, said pin being a fulcrum about which said flange is rotated.

19. The method of claim 18 in which a ridge is located near the pin, said ridge having a side parallel to the longitudinal axis of the keyhole and spaced apart therefrom by a distance equal to the radius of the flange, said pin and ridge being located such that contact is made with the sectioned flange during installation of the handle on the container.

20. The method of claim 17 in which the fulcrum is a ridge, said ridge extending along one edge of the keyhole slot and around a major section of said keyhole orifice, said ridge increasing in height between said open end of the tapered slot and said orifice, said ridge cooperatively contacting said sectioned flange for insertion of handle through said keyhole slot and into said orifice.

21. The method of claim 17 in which the flanges on the shaft are spaced apart, with one flange attached to said handle.

22. The method of claim 17 in which the flanges on the shaft are spaced apart, and separated from said handle.

23. The method of claim 17 in which one flange is sectioned.

24. The method of claim 17 in which the flange proximal to the handle is sectioned.

25. The method of claim 17 in which the flange distal to the handle is sectioned.

26. The method of claim 17 in which both flanges are sectioned.

27. The method of claim 17 in which the shaft is substantially perpendicular to the handle.

28. The method of claim 17 in which the container is a pail.

* * * * *